United States Patent [19]

McIntosh

[11] Patent Number: 4,736,514

[45] **Date of Patent: * Apr. 12, 1988**

[54] METHOD OF MAKING ELECTRICAL SWITCH

[75] Inventor: Harold A. McIntosh, Crestline, Calif.

[73] Assignee: Robertshaw Controls Company, Richmond, Va.

[ * ] Notice: The portion of the term of this patent subsequent to Dec. 30, 2003 has been disclaimed.

[21] Appl. No.: 885,865

[22] Filed: Jul. 15, 1986

Related U.S. Application Data

[62] Division of Ser. No. 694,350, Jan. 24, 1985, Pat. No. 4,633,211.

[51] Int. Cl.[4] ..... H01H 11/00

[52] U.S. Cl. ..... 29/622; 200/67 E; 200/DIG. 42

[58] Field of Search ..... 29/622; 200/67 E, 67 D, 200/DIG. 42; 337/337, 338, 340, 342, 347, 349, 363, 364, 368

[56] References Cited

U.S. PATENT DOCUMENTS

| | | | |
|---|---|---|---|
| 847,981 | 3/1907 | Brown | 337/364 |
| 2,720,568 | 10/1955 | Bletz | 337/347 |
| 3,047,771 | 7/1962 | Clark | 337/364 |
| 3,435,189 | 3/1969 | Manecke | 219/321 |
| 4,110,573 | 8/1978 | Doi | 200/67 DA |
| 4,499,346 | 2/1985 | Portmann | 200/67 D |

*Primary Examiner*—P. W. Echols

*Attorney, Agent, or Firm*—Candor, Candor & Tassone

[57] ABSTRACT

An electrical switch construction and method of making the same are provided, the switch construction having a support carrying a pair of spaced apart first and second fixed contacts and a movable switch blade unit carrying a contact unit for being disposed in contact with the first fixed contact and out of contact with the second fixed contact when the switch blade unit is in a first position thereof and for being disposed in contact with the second fixed contact and out of contact with the first fixed contact when the switch blade unit is in a second position thereof. The switch blade unit comprises a first flexible switch blade having opposed ends one of which is secured to the support and the other of which carries a first part of the contact unit for making or breaking contact with the first fixed contact and a second flexible switch blade having opposed ends one of which is secured to the first switch blade to be carried thereby and the other of which is spaced from the other end of the first switch blade and carries a second part of the contact unit for making or breaking contact with the second fixed contact. The first switch blade having an abutment for engaging the second switch blade with an impact force when the switch blade unit is being moved from the second position thereof to the first position thereof and a contact welded condition exists between the second fixed contact and the second part of the contact unit.

12 Claims, 6 Drawing Sheets

METHOD OF MAKING ELECTRICAL SWITCH

CROSS REFERENCE TO RELATED APPLICATION

This application is a divisional patent application of its copending parent patent application, Ser. No. 694,350 filed Jan. 24, 1985, now U.S. Pat. No. 4,633,211.

BACKGROUND OF THE INVENTION

1. Field of the Invention

This invention relates to a new electrical switch construction and to a method of making such a switch construction or the like.

2. Prior Art Statement

It is known to provide an electrical switch construction having a support means carrying a pair of spaced apart first and second fixed contacts and a movable switch blade unit carrying contact means for being disposed in contact with the first fixed contact and out of contact with the second fixed contact when the switch blade unit is in a first position thereof and for being disposed in contact with the second fixed contact and out of contact with the first fixed contact when the switch blade unit is in a second position thereof. For example, see Manecke, U.S. Pat. No. 3,435,189; Schmitt, U.S. Pat. No. 3,573,700; Place, U.S. Pat. No. 3,602,863; Manecke, U.S. Pat. No. 3,885,222 and Rowley, U.S. Pat. No. 4,365,228.

It is known to provide a movable switch blade unit for the above prior known electrical switch construction wherein the switch blade unit comprises a first flexible switch blade means having opposed ends one of which is secured to the support means and the other of which carries a first part of the contact means for making or breaking contact with the first fixed contact and a second flexible switch blade means having opposed ends one of which is secured to the first switch blade means to be carried thereby and the other of which is spaced from the other end of the first switch blade means and carries a second part of the contact means for making or breaking contact with the second fixed contact. For example, see Brown, U.S. Pat. No. 847,981 and Clark, U.S. Pat. No. 3,047,771.

It is also known to provide an electrical switch construction having a support means carrying a fixed contact and a movable contact carried by a switch blade, a bimetallic snap disc carried by the support means for controlling movement of the switch blade relative to the fixed contact and responsive to temperature setting means carried by the support means for selecting the temperature of operation of the disc for moving the movable contact out of contact with the fixed contact, the temperature setting means comprising a substantially cup-shaped plunger means having an open end for engaging the blade and a closed end engaging the snap disc, the temperature setting means having spring means operatively associated with the plunger means to urge the plunger means into engagement with the snap disc, the temperature setting means having adjusting means for adjusting the force of the spring means that urges the plunger means into the engagement thereof, the spring means having opposed ends one of which is operatively interconnected to the plunger means and the other of which engages the adjusting means. For example, see the aforementioned Manecke, U.S. Pat. No. 3,885,222.

SUMMARY OF THE INVENTION

It is one feature of this invention to provide a new electrical switch construction having a unique switch blade unit.

In particular, it was found according to the teachings of this invention that a unique switch blade unit can be provided so as to have the contact means thereof disposed in contact with a first fixed contact and out of contact with a second fixed contact that is spaced from the first fixed contact when the switch blade unit is in a first position thereof and for being disposed in contact with the second fixed contact and out of contact with the first fixed contact when the switch blade unit is in a second position thereof if the switch blade unit comprises a first flexible switch blade means having opposed ends one of which is secured to a support means of the switch construction and the other of which carries a first part of the contact means for making or breaking contact with the first fixed contact and a second flexible switch blade means having opposed ends one of which is secured to the first switch blade means to be carried thereby and the other of which is spaced from the other end of the first switch blade means and carries a second part of the contact means for making or breaking contact with the second fixed contact.

In this manner, the spacing between the contact carrying ends of the two switch blade means can be readily adjusted by unique adjusting means in a manner hereinafter set forth and such unique adjusting means can be utilized to tend to break any weld that occurs between the contact of the second switch blade means and the second fixed contact as will be apparent hereinafter.

Therefore, one embodiment of this invention provides an electrical switch construction having a support means carrying a pair of spaced apart first and second fixed contacts and a movable switch blade unit carrying contact means for being disposed in contact with the first fixed contact and out of contact with the second fixed contact when the switch blade unit is in a first position thereof and for being disposed in contact with the second fixed contact and out of contact with the first fixed contact when the switch blade unit is in a second position thereof, the switch blade unit comprising a first flexible switch blade means having opposed ends one of which is secured to the support means and the other of which carries a first part of the contact means for making or breaking contact with the first fixed contact and a second flexible switch blade means having opposed ends one of which is secured to the first switch blade means to be carried thereby and the other of which is spaced from the other end of the first switch blade means and carries a second part of the contact means for making or breaking contact with the second fixed contact. The first switch blade means has abutment means for engaging the second switch blade means with an impact force when the switch blade unit is being moved from the second position thereof to the first position thereof and a contact welded condition exists between the second fixed contact and the second part of the contact means.

Another feature of this invention is to provide a new electrical switch construction having unique actuator means for operating the switch blade thereof.

In particular, it was found according to the teachings of this invention that the spring means of the temperature setting means for the bimetallic snap disc of the electrical switch construction of this invention can have one end thereof received within the substantially cup-shaped plunger means that has an open end for engaging the switch blade and a closed end for engaging the snap disc whereby the overall length of the actuator means of this invention is relatively short while still being effective for its intended use so that the overall height of the switch construction can be relatively small as will be apparent hereinafter.

Therefore, another embodiment of this invention provides an electrical switch construction having a support means carrying a fixed contact and a movable contact carried by a switch blade. A bimetallic snap disc is carried by the support means for controlling movement of the switch blade relative to the fixed contact in response to temperature setting means carried by the support means for selecting the temperature of operation of the disc for moving the movable contact out of contact with the fixed contact, the temperature setting means comprising a substantially cup-shaped plunger means having an open end for engaging the blade and a closed end engaging the snap disc. The temperature setting means has spring means operatively associated with the plunger means to urge the plunger means into engagement with the snap disc. The temperature setting means also has adjusting means for adjusting the force of the spring means that urges the plunger means into its engagement. The spring means has opposed ends one of which is operatively interconnected to the plunger means and the other of which engages the adjusting means, the one end of the spring means being received in the open end of the plunger means.

Accordingly, it is an object of this invention to provide a new electrical switch construction having one or more of the novel features of this invention as set forth above or hereinafter shown or described.

Another object of this invention is to provide a new method of making such an electrical switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
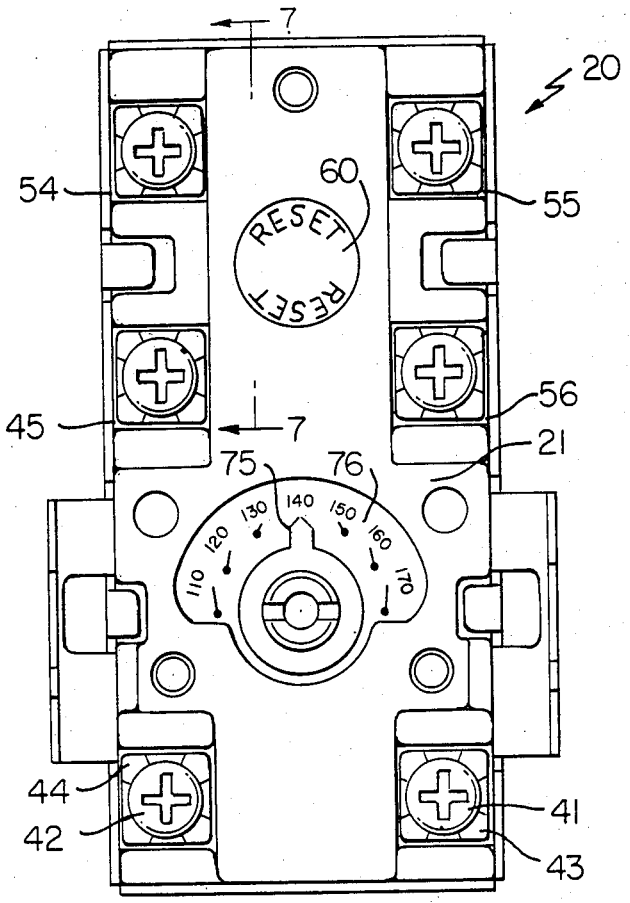
FIG. 1 is a front view of the new switch construction of this invention.
Figure 9:
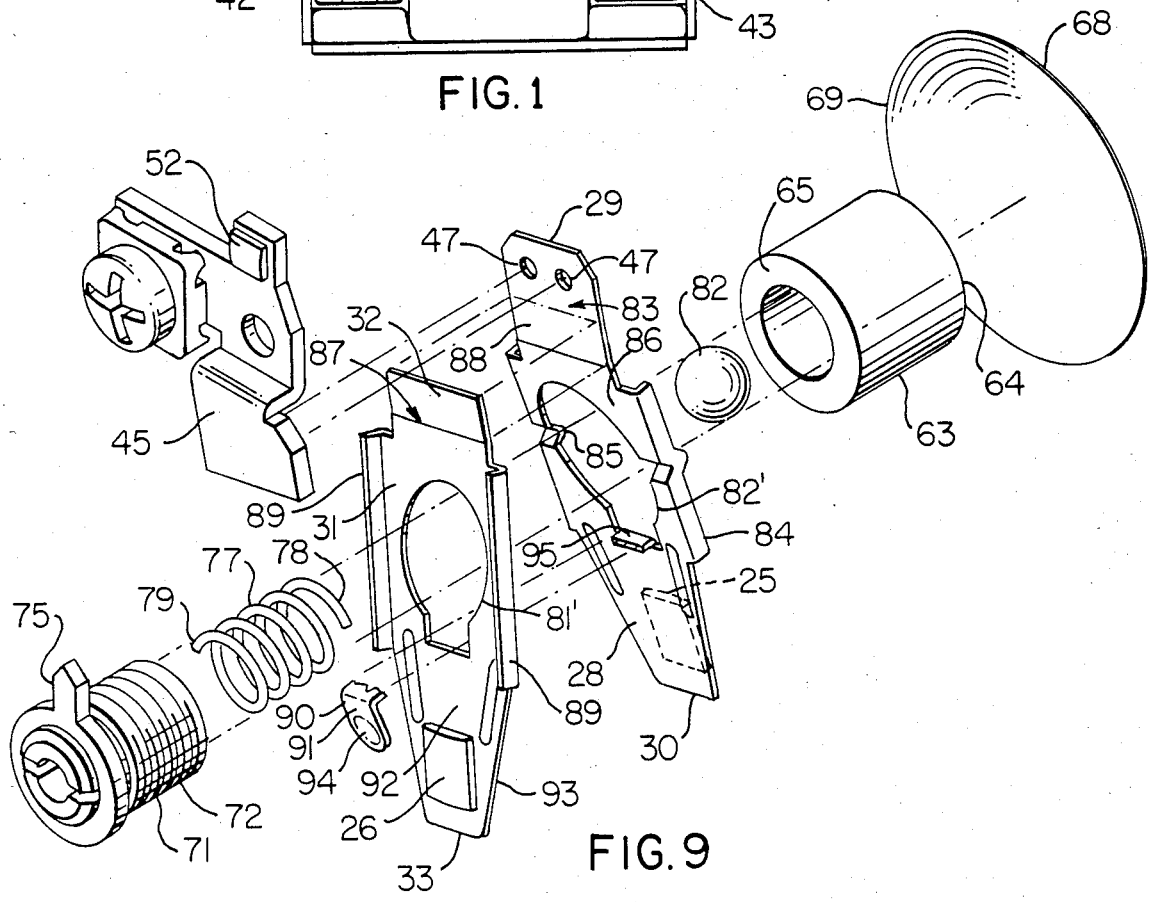
FIG. 9 is an exploded perspective view of the switch blade means and temperature setting means of the switch construction of FIGS. 1–8.

While the various features of this invention are hereinafter illustrated and described as being particularly adapted to provide an electrical switch construction particularly adapted to be utilized for controlling the operation of an electrically heated water tank, such as for a house and the like, it is to be understood that the various features of this invention can be utilized singly or in various combinations thereof to provide an electrical switch construction for controlling the operation of other apparatus as desired.

Therefore, this invention is not to be limited to only the embodiments illustrated in the drawings, because the drawings are merely utilized to illustrate one of the wide variety of uses of this invention.

Figure 2:
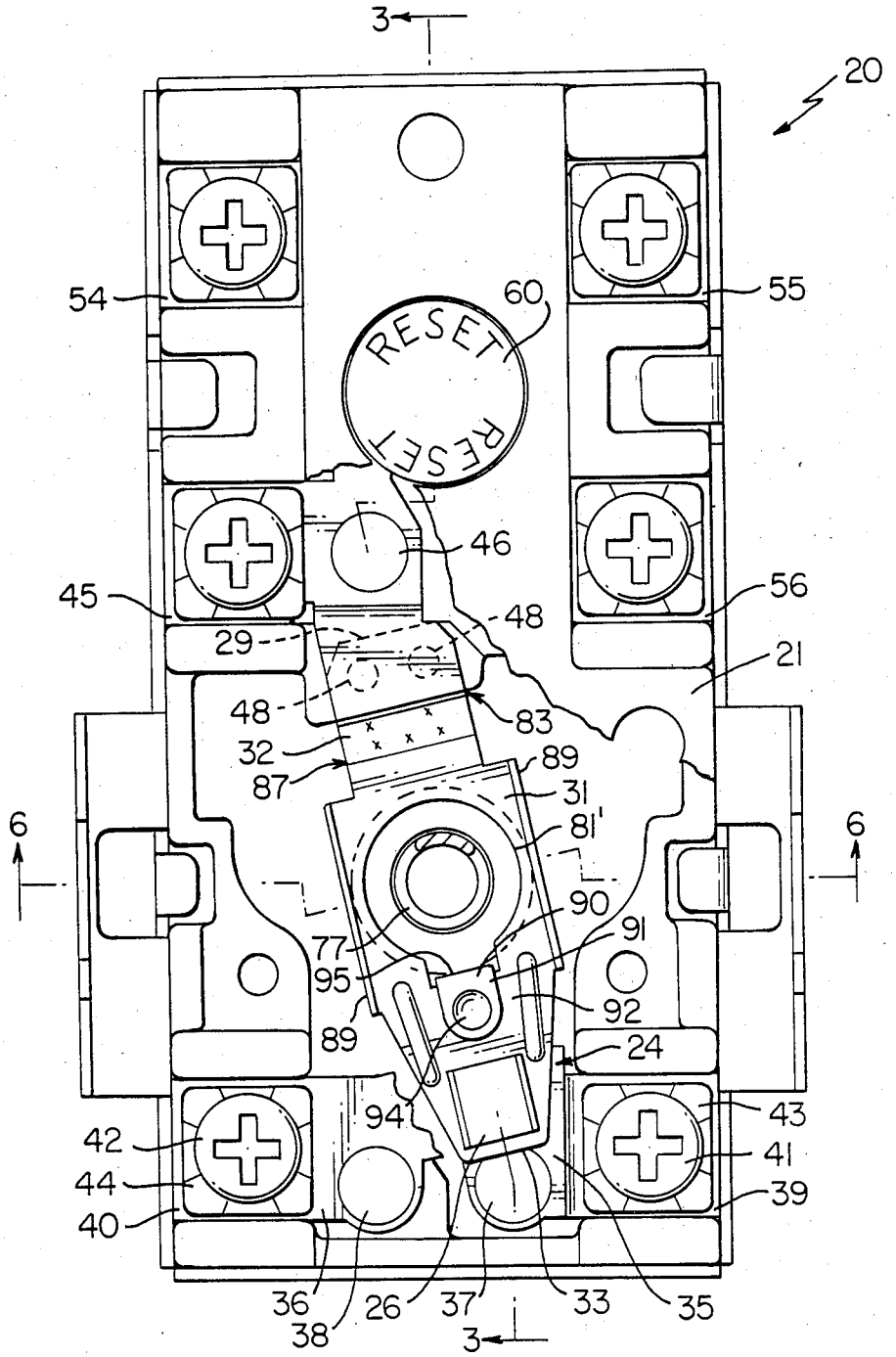
FIG. 2 is an enlarged view similar to FIG. 1 with a portion of the housing means broken away to illustrate the switch blade means thereof.
Figure 3:
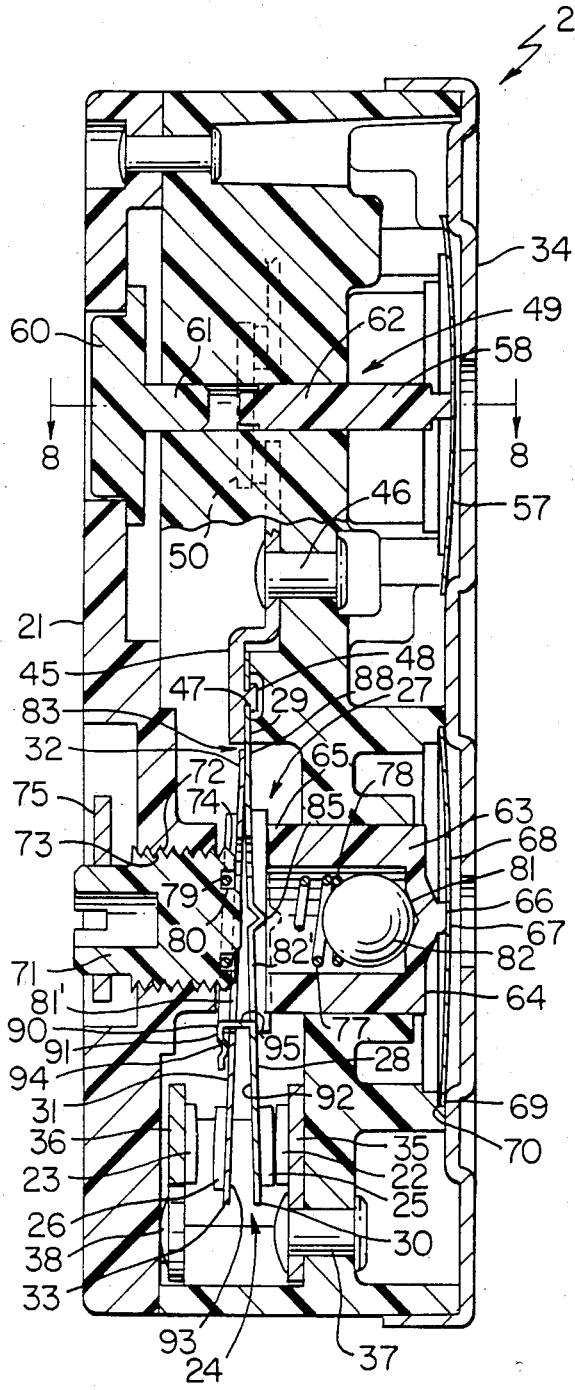
FIG. 3 is a cross-sectional view taken on line 3—3 of FIG. 2.
Figure 4:
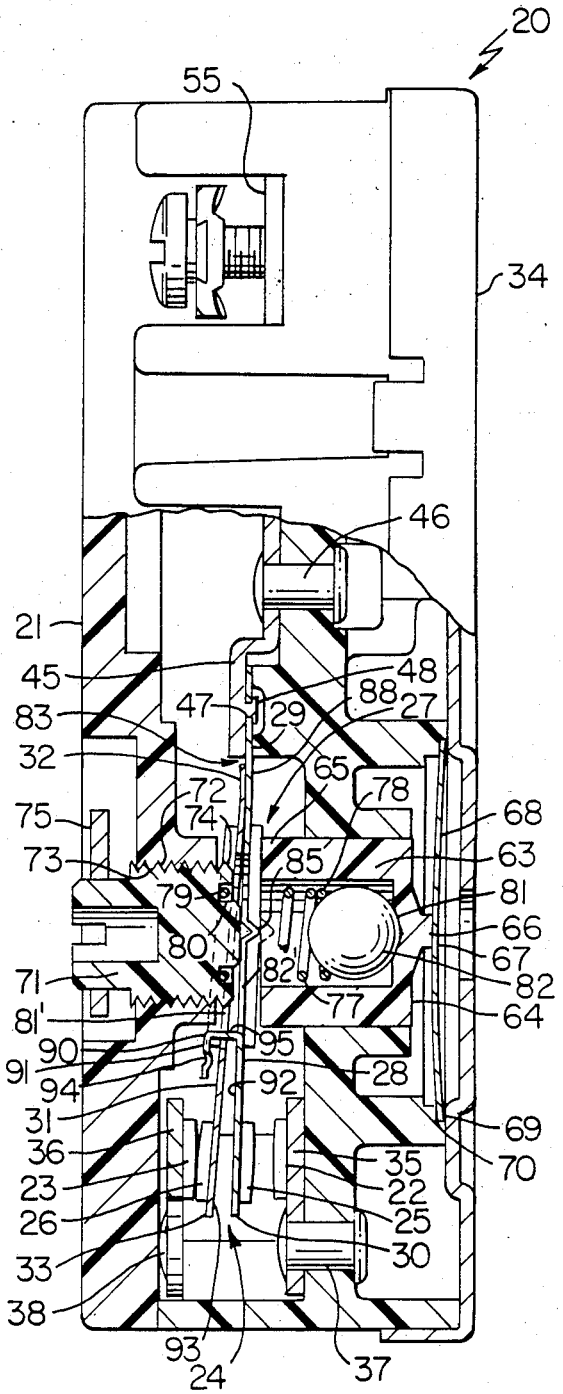
FIG. 4 is a view similar to FIG. 3 and illustrates the switch construction in another operating position thereof.

Referring now to FIGS. 1–3, the new electrical switch construction of this invention is generally indicated by the reference numeral 20 and comprises a housing means or support means 21 carrying a first fixed contact 22 and a second fixed contact 23 spaced from the first fixed contact 22. The support means 21 also carries a switch blade unit that is generally indicated by the reference numeral 24 and has contact means 25, 26 that is adapted to be disposed in contact with the first fixed contact 22 and out of contact with the second fixed contact 23 when the switch blade unit 24 is in a first position thereof as illustrated in FIG. 3 and for being disposed in contact with the second fixed contact 23 and out of contact with the first fixed contact 22 when the switch blade unit 24 is in a second position thereof as illustrated in FIG. 4, the switch blade unit 24 being operated by an actuating means of the switch construction 20 that is generally indicated by the reference numeral 27 and is hereinafter described.

The unique switch blade unit 24 of this invention comprises a first one-piece flexible metallic switch blade means 28 having opposed ends 29 and 30 one end 29 of which is secured to the support means 21 and the other 30 of which carries the first part 25 of the contact means 25, 26 for making or breaking contact with the first fixed contact 22 and a second one-piece flexible metallic switch blade means 31 having opposed ends 32 and 33 one end 32 of which is secured to the first switch blade means 28 to be carried thereby and the other end 33 of which is spaced from the other end 30 of the first switch blade means 28 and carries the second part 26 of the contact means 25, 26 for making or breaking contact with the second fixed contact 23.

The electrical switch construction 20 is adapted to be utilized as an electrical water heater control device or thermostat in a manner well known in the art such as in the manner set forth in the aforementioned U.S. Pat. Nos. 3,435,189; 3,575,700; 3,602,863; 3,885,222 and 4,365,228 whereby these five U.S. Patents are being incorporated into this disclosure by this reference thereto so that the operation of an electrically heated water tank need not be described in this application as the same is conventional in the art.

Accordingly, only the details of the switch construction 20 of this invention that is necessary to understand the unique features of the switch construction 20 of this invention will now be described and the remaining structure thereof will be merely described in general as the details and operation thereof can be readily obtained from the aforementioned five U.S. Patents.

The housing means 21 of the electrical switch construction 20 is formed from electrically insulating material except for a rear cover 34 which is formed of metallic material as well as the various metallic terminal means that are fastened to the housing means 21 by the metallic rivet means as illustrated.

For example, the fixed contacts 22 and 23 are respectively carried by rigid metallic terminal means 35 and 38, the terminals 35 and 36 having external portions 39 and 40, FIG. 2, to which external leads (not shown) can be secured thereto by the threaded fastening members 41 and 42 and their associated lead clamping washers 43 and 44 in a manner conventional in the art.

The switch blade means 28 is secured to an internal metallic bus bar member or terminal 45 that is held in place by a rivet means 46, the end 29 of the switch blade means 28 having two openings 47 passing therethrough and through which rivet-like portions 48 of the terminal 45 are formed and staked over to fasten the switch blade means 28 in a cantilevered fashion by its end 29 to the housing means or support means 21 as illustrated.

Figure 8:
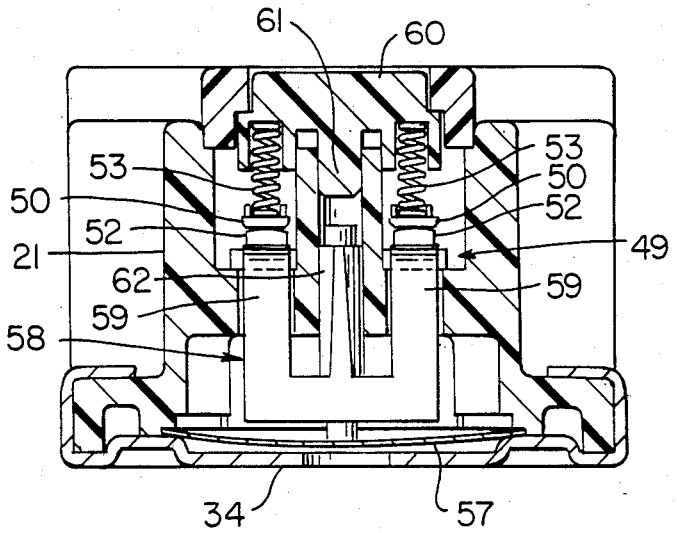
FIG. 8 is a cross-sectional view taken on line 8—8 of FIG. 3.

An electrical connection to the terminal 45, and, thus, to the switch blade unit 24 is controlled by a high limit electrical switch arrangement that is generally indicated by the reference numeral 49 and comprises a pair of bridging members 50 normally urged into bridging contact with fixed contacts 51 and 52 by respective compression springs 53 so that terminals 54 and 55 can be respectively electrically interconnected to terminals 45 and 56 as long as a high temperature bimetal snap disc 57 is in the condition illustrated in FIGS. 3 and 8 so that an actuating plunger means 58 that is disposed between the snap disc 57 and the bridging members 50 is in a non-actuating position thereof. However, when the snap disc 57 snaps over center because the same is sensing an unsafe high temperature, the snap disc 57 causes the plunger 58 to have the legs 59 thereof engage against the bridging members 50 and move the same away from the spaced apart fixed contacts 51 and 52 in opposition to the force of the compression springs 53 to terminate the electrical connection of the terminals 54 and 55 from the terminals 45 and 56 for the reasons fully set forth in the aforementioned U.S. Patents.

A reset button 60 is carried by the housing means 21 and has a projection 61 for engaging against a central leg 62 of the actuator 58 to reset the bimetal disc 57 from its snapped over condition back to the condition illustrated in FIG. 3 when the bimetal disc 57 is no longer sensing an unsafe high temperature whereby the compression springs 53 are adapted to place the bridging members 50 back into bridging relation with the fixed contacts 51 and 52 so that the terminals 54 and 55 can again be electrically interconnected to the terminals 45 and 56 for the reasons set forth in the aforementioned U.S. Patents.

In this manner, an external power source lead (not shown) electrically connected to the terminal 54 of the housing means 21 is adapted to be electrically interconnected to the switch blade unit 24 through the bridging member 50 and terminal 45 as long as the bimetal member 57 is in the condition illustrated in FIG. 3. Thus, the switch blade unit 24 is adapted to interconnect the terminal 54 to either the external terminal portion 39 through the first fixed contact 22 when the switch blade unit 24 is in the position illustrated in FIG. 3 or to the external terminal portion 40 through the second fixed contact 23 when the switch blade unit 24 is in its second position as illustrated in FIG. 4 to control the heating of water tank as will be apparent hereinafter.

The actuating means 27 for controlling the switch blade unit 24 of the switch construction 21 of this invention comprises a cup-shaped plunger means 63 having a closed end 64 and an open end 65, the closed end 64 having a external projection 66 that is adapted to abut the medial portion 67 of a bimetallic snap disc 68 that has its outer periphery 69 held in an annular groove 70 of the housing means 21 by the cover 34 in a manner well known in the art whereby the bimetallic snap disc 68 when disposed in the position illustrated in FIG. 3, by sensing a temperature below a temperature as selected by an adjusting means 71 of the actuator means 27 in a manner hereinafter set forth, will cause the switch blade unit 24 to be maintained in the condition illustrated in FIG. 3 through the natural bias of the first switch blade means 28 as will be apparent hereinafter.

However, when the bimetal disc 68 senses a temperature above the temperture setting of the adjusting means 71, the bimetal member 68 snaps over center and causes the plunger 63 to have its open end 65 act against the switch blade unit 24 and move the switch blade unit 24 from the first position thereof illustrated in FIG. 3 to the second position thereof illustrated in FIG. 4 wherein the contact 25 is disposed out of contact with the fixed contact 22 and the contact 26 is disposed in contact with the fixed contact 23 whereby the internal terminal 45 is now interconnected to the internal terminal 36 rather than to the internal terminal 35 for the reasons fully set forth in the aforementioned U.S. Patents.

The adjusting member 71 of the switch construction 20 is externally threaded at 72 and is threadedly disposed in a threaded bore 73 in the housing means 21 so that rotation of the adjusting member 71 axially moves its end 74 in and out of the housing 21 while a pointer 75 thereof moves over a temperature selector scale 76 in a manner well known in the art.

A coiled compression spring 77 forms part of the actuating means 27 and has one end 78 operatively interconnected to the plunger means 63 while the other end 79 thereof bears against the adjusting means 71 and is received in an annular groove 80 thereof as illustrated, the spring 77 passing through suitable openings 81' and 82' formed through the switch blade means 31 and 28 as illustrated.

In this manner, the force of the compression spring 77 acts to hold the plunger means 63 against the snap disc 68 and to select the temperature that is required to cause the snap disc 68 to snap over center from the position illustrated in FIG. 3 to the position illustrated in FIG. 4 in a manner well known in the art.

In order to facilitate the mounting of the end 78 of the spring 77 in the cup-shaped plunger member 63, the closed end 64 of the cup-shaped plunger means 63 has a substantially conical surface means 81 formed medially thereof and receiving a metallic spherical ball 82 as illustrated. In this manner, the end 78 of the compression spring is adapted to seat on the ball 82 whereby the ball 82 effectively interconnects the end 78 of the spring 77 to the plunger means 63 to urge the plunger means 63 against the snap disc 68 while permitting misalignment between the plunger means 63 and the adjusting member 71 as well as permitting the length of the spring 77 to be substantially the same length as springs utilized for similar purposes in the prior known thermostat constructions with the distance between the adjusting means 71 and plunger means 63 of this invention being substantially reduced so as to permit the overall height of the switch construction 21 of this invention to be relatively small.

In this manner, rotation of the adjusting member 71 in a direction to increase the temperature setting of the pointer 75 thereof causes the member 73 to thread further into the housing means 21 and thus compress the spring 77 to a greater degree so that the snap disc 68 cannot snap over center from the position illustrated in FIG. 3 to the position illustrated in FIG. 4 until the same senses the increased temperature setting of the adjusting member 71. Conversely, movement of the adjusting member 71 to a lower temperature setting of the pointer 75 causes the member 71 to thread out of the support means 21 so that the force of the compression spring 77 is reduced to thereby lower the temperature that the snap disc 68 will sense in order to snap over center from the condition illustrated in FIG. 3 to the position illustrated in FIG. 4.

The first switch blade means 28 of the switch blade unit 24 is provided with a flexure portion 83 that is disposed closely adjacent the end 29 thereof and has side stiffening portions 84 bent at right angles relative thereto to assure that the switch blade means 28 will flex at the flexure portion 83 thereof that is disposed closely adjacent to the terminal 45 when the open end 65 of the plunger means 63 engages against knife edges 85 of a medial portion 86 of the switch blade means 28 inboard of the stiffening ribs 84 as illustrated.

The switch blade means 31 of the switch blade unit 24 is also provided with a flexure portion 87 that is disposed closely adjacent the end 32 thereof that is spot welded to the mating portion 88 of the switch blade means 28, the switch blade means 31 also being stiffened by the stiffening means 89 being bent at right angles thereto to assure the flexure of the switch blade means 31 in the flexure area 87 thereof.

An L-shaped tang 90 is carved and bent from the switch blade means 28 in such a manner that a part 91 thereof is adapted to be disposed adjacent the side 92 of the switch blade means 31 that is opposite to the side 93 thereof that faces the switch blade means 28, the part 91 being formed with a dimple 94 which is adapted to bear against the side 92 of the switch blade means 31 when the same are disposed in the position illustrated in FIG. 3 whereby the tang 90 comprises an adjustable restraining means for setting the spacing between the ends 30 and 33 of the switch blade means 28 and 31.

In particular, the switch blade means 31 is secured to the switch blade means 28 in such a manner that the same normally has a bias to move the end 33 thereof away from the end 30 of the switch blade means 28 a certain distance except that the part 91 of the restraining means 90 prevents the end 33 of the switch blade means 31 from moving its full distance away from the end 30 of the switch blade means 28. In this manner, by adjusting the position of the part 91, such as by bending the part 91 relative to an upstanding part 95 of the tang 90, the distance between the adjacent ends 33 and 30 of the switch blade means 31 and 28 can be selected so that the switch blade unit 24 can be adjusted to make sure that the contact 25 leaves the contact 22 before the contact 26 makes contact with the contact 23 and that the contact 26 will not make contact with the contact 23 when the contact 25 is against the contact 22.

Further, since the switch blade unit 24 is initially mounted to the terminal member 45 by the switch blade means 28 so that the resultant normal bias of the switch blade means 28 for the switch blade unit 24 is toward the fixed contact 22, the switch blade means 28 moves its contact 25 against the contact 22 when the member 68 snaps over center from the condition illustrated in FIG. 4 back to the condition illustrated in FIG. 3 whereby this normal bias of the switch blade means 28 to move the switch blade unit 24 from the position illustrated in FIG. 4 to the position illustrated in FIG. 3 can be utilized with the restraining means 90 to break any weld existing between the contacts 26 and 23 when the switch blade unit 24 is disposed in the position illustrated in FIG. 4.

In particular, it can be seen that when the switch blade unit 24 is disposed in the position illustrated in FIG. 4, the plunger means 63 has caused the switch blade means 28 to move its end 30 closer to the end 33 of the switch blade means 31 so that the part 91 has the dimple 94 thereof spaced away from the side 92 of the switch blade means 31 as long as the contact 26 is in contact with the contact 23 as illustrated.

Figure 5:
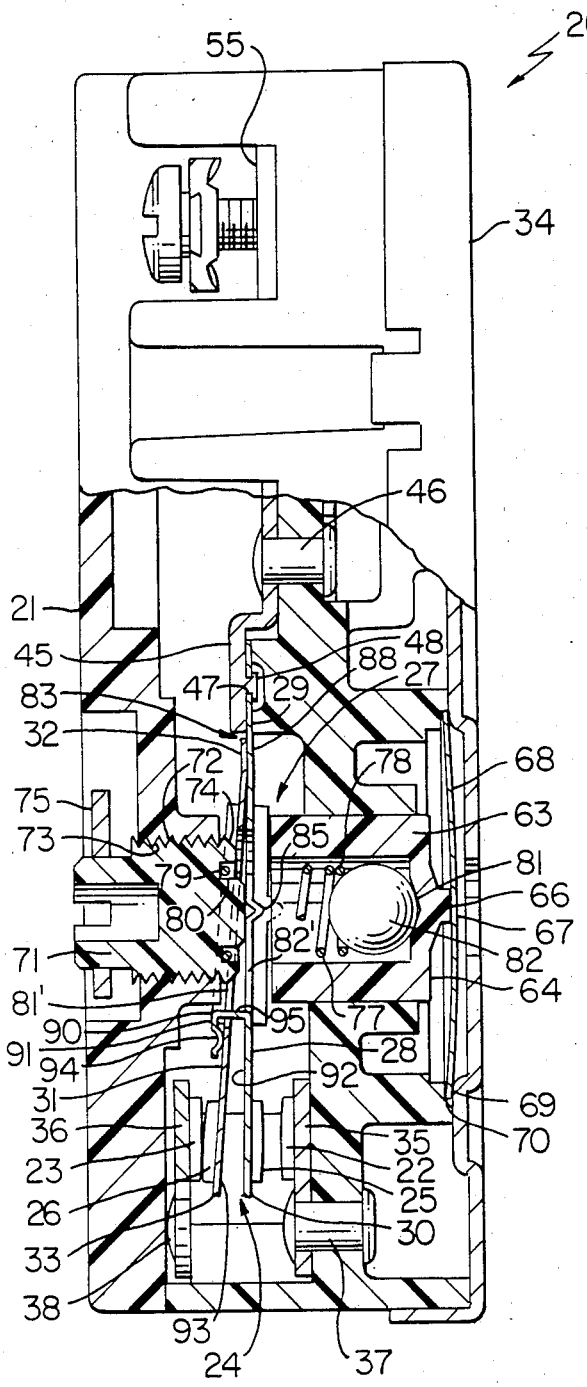
FIG. 5 is a view similar to FIG. 4 and illustrates the switch construction in another operating position thereof.
Figure 7:
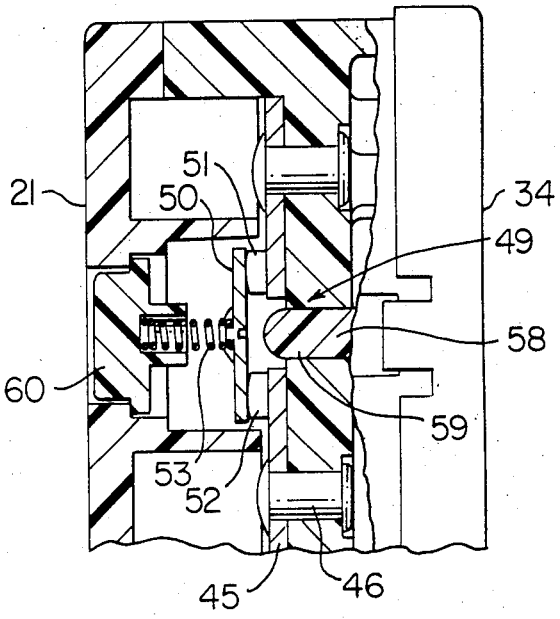
FIG. 7 is an enlarged fragmentary cross-sectional view taken on line 7—7 of FIG. 1.

Thus, when the bimetal disc 68 snaps over center form the position illustrated in FIG. 4 to the position illustrated in FIG. 3, the switch blade means 28 begins to move in a direction to cause the contact 25 thereof to move toward the contact 22 and the switch blade means 28 builds up inertia before the part 91 engages against the side 92 of the switch blade means 31 so that the part 91 actually engages against the side 92 of the switch blade means 31 with an impact force as illustrated in FIG. 5 to break any weld that might exist between the contacts 26 and 23 and carries the switch blade means 31 therewith to move the contact 26 out of contact with the contact 23 and place the contact 25 into contact with the contact 22 as illustrated in FIG. 3.

It is to be understood that instead of merely bending the part 91 relative to the upstanding part 95 to change the spacing between the ends 33 and 30 of the switch blade means 31 and 28 as previously described, the part 91 could carry a threaded adjusting member for such purpose.

Figure 10:
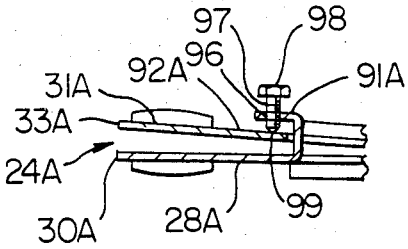
FIG. 10 is a fragmentary side view of another embodiment of the switch blade means of this invention.
Figure 6:
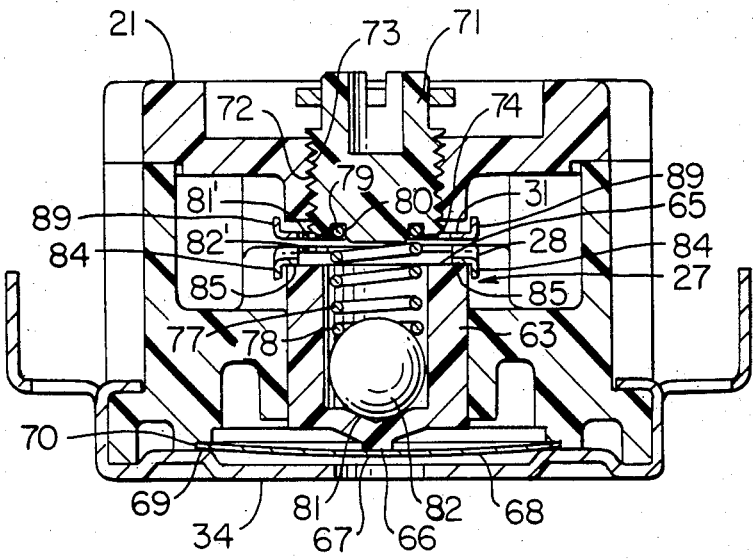
FIG. 6 is a cross-sectional view taken on line 6—6 of FIG. 2.

For example, reference is now made to FIG. 10 wherein another switch blade unit 24A of this invention is provided and the parts thereof that are similar to the switch blade unit 24 are indicated by like reference numerals followed by the reference letter "A".

As illustrated in FIG. 10, the part 91A of the switch blade means 28A has a threaded opening 96 passing therethrough and receiving a threaded shank 97 of a threaded adjusting member 98 whereby the end 99 of the adjusting member 98 is adapted to abut against the side 92A of the switch blade means 31A so that by merely threading in or out the adjusting member 98 relating to the part, the spacing between the ends 33A and 30A of the switch blade means 31A and 28A can be selected for the purpose previously set forth.

Therefore, it can be seen that the electrical switch construction 20 of this invention can be formed in a relatively simple manner by the method of this invention from the parts formed in the manner previously set forth so that the resulting electrical switch construction 20 is adapted to operate in a manner now to be set forth.

The electrical switch construction 20 is adapted to be electrically interconnected in an electrical heater system (not shown) to control the temperature of a water tank (not shown) in the manner fully set forth in the aforementioned U.S. Patents whereby the operator can rotate the adjusting member 71 so that the pointer 75 thereof will indicate the desired water temperature on the scale 76 that the electrical switch construction 20 is to maintain, the adjusting member 71 setting the force of the compression spring 77 that acts through the ball 82 and the plunger means 63 against the medial portion 67 of the snap disc 68.

As long as the temperature sensed by the snap disc 68 is below the temperature setting of the adjusting member 71, the snap disc 68 is in the condition illustrated in FIG. 3 so that the natural bias of the switch blade means 28 maintains the contact 25 thereof against the fixed contact 22 while the arm or restraining means 90 maintains the contact 26 of the other switch blade means 31 out of contact with the fixed contact 23.

However, when the snap disc 68 senses a temperature at or slightly above the temperature of the setting of the adjusting member 71, the snap disc 68 snaps over center and causes the plunger 63 to engage against the knife edges 85 of the switch blade means 28 and move the switch blade means 28 in a direction away from the contact 22 so that the contact 25 is moved out of contact with the contact 22 and the contact 26 is placed into contact with the contact 23 to change the electrical connection through the switch construction 20 and thereby to cause the electrical heater means for the water heater to reduce the temperature of the water heater arrangement until the same falls below the temperature setting of the adjusting member 71 whereby the snap disc 68 then snaps back over center from the position illustrated in FIG. 4 to the position illustrated in FIG. 3. At this time, the natural bias of the switch blade means 28 follows the plunger 63 being moved from left to right in FIGS. 3 and 4 by the spring 77 and causes the restraining member 90 to impact against the switch blade means 31 as the restrainging member 90 is moved from the position illustrated in FIG. 4 to the position illustrated in FIG. 5 and thereby breaks any weld that exists between the contact 26 and 23 and moves the contact 25 into contact with the contact 22 while the contact 26 is moved out of contact with the contact 23 as previously set forth.

Thus, it can be seen that when the snap disc 68 snaps over center from the position illustrated in FIG. 3 to the position illustrated in FIG. 4, the snapping force of the disc 68 is sufficient to break any weld that exists between the contacts 25 and 22, whereas the natural force of the switch blade means 28 might not be sufficient by itself to normally break a weld that exists between the contacts 26 and 23. However, the impacting force of the portion 91 against the switch blade means 31 is believed to be sufficient to break a weld that exists between the contacts 26 and 23.

While the switch blade means 28 and 31 have been illustrated and described as each being formed as a one-piece structure, it is to be understood that the same could each be formed from a plurality of parts, if desired.

For example, reference is now made to FIGS, 11 and 12 wherein another embodiment of the switch blade unit of this invention is generally indicated by the reference numeral 24B and parts thereof similar to the switch blade unit 24 are indicated by like reference numerals followed by the reference letter "B".

Figure 11:
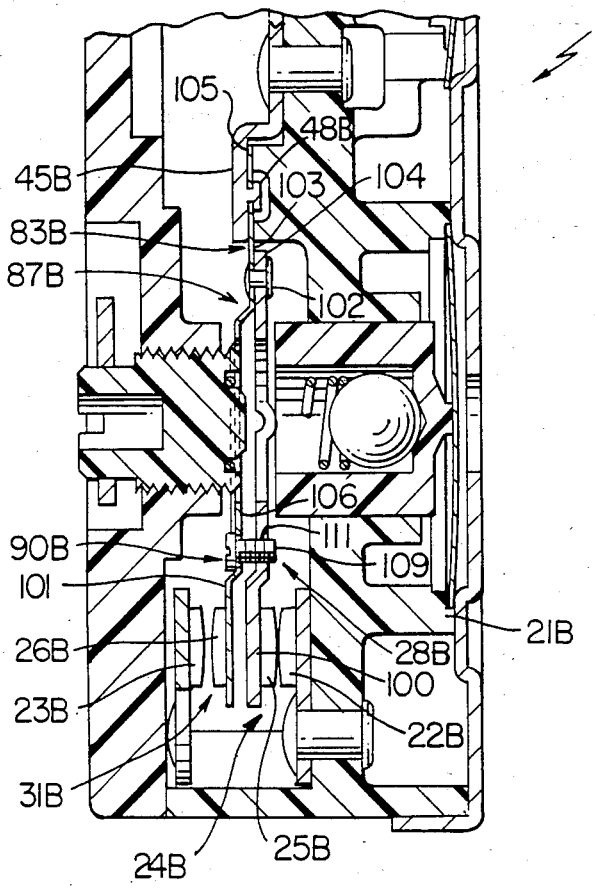
FIG. 11 is a fragmentary view similar to FIG. 3 and illustrates another embodiment of the switch blade means of this invention.
Figure 12:
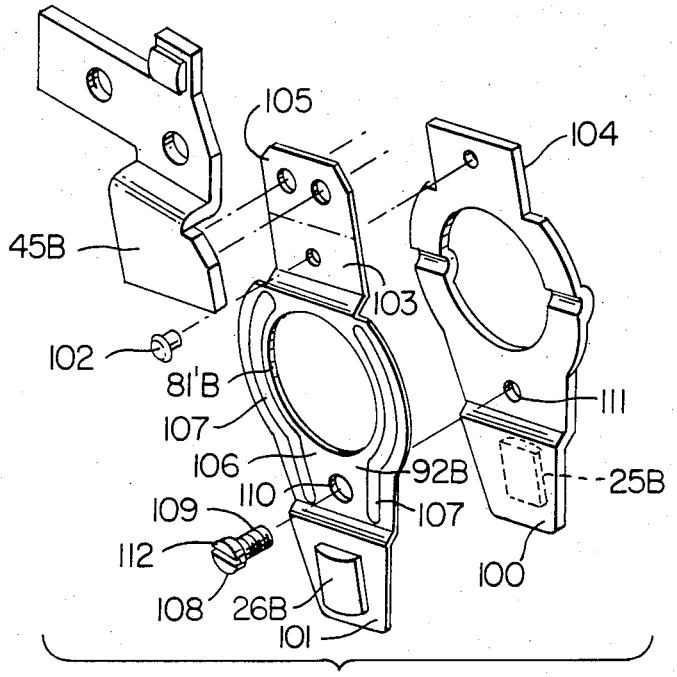
FIG. 12 is an exploded perspective view of the switch blade means of the switch construction of FIG. 11.
Figure 14:
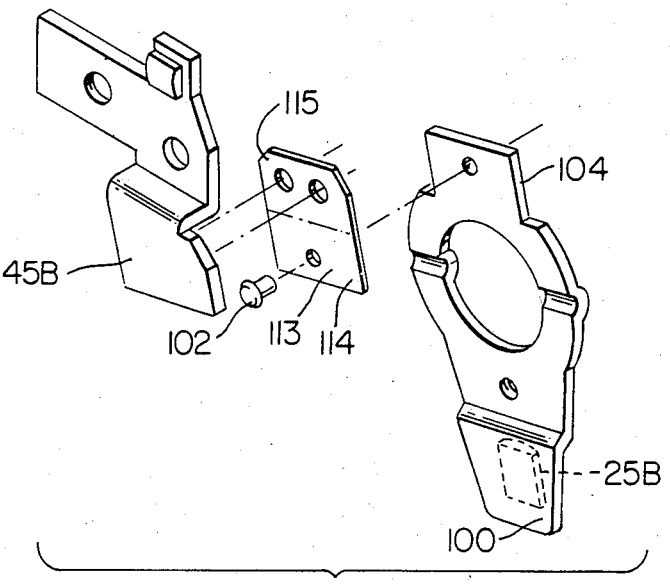
FIG. 14 is an exploded perspective view of the switch blade means of the switch construction of FIG. 13.

As illustrated in FIGS. 11 and 12, the switch construction 20B is substantially the same as the switch construction 20 previously described except that the switch blade unit 24B thereof is formed somewhat differently than the switch blade unit 24 previously described although the switch blade unit 24B operates substantially in the same manner as the switch blade unit 24 as will be apparent hereinafter, the switch blade unit 24B presently being the preferred embodiment of this invention.

As illustrated in FIGS. 11 and 12, the switch blade unit 24B comprises two one-piece metallic members 100 and 101 secured together by a rivet means 102, as well as suitable spot welds on each side of the rivet means 102, that fastens a portion 103 of the member 101 to the end 104 of the member 100 whereby a projecting end portion 105 of the member 101 extends beyond the end 104 of the member 100 and together with the member 100 defines the first switch blade means 28B of the switch blade unit 24B that carries the contact 25B for engaging against the first fixed contact 22B of the housing means 21B as illustrated in FIG. 11, the part 105 of the member 101 being secured to the terminal member 45B by the rivet means 48B, as well as by spot welding thereto, so that the portion 105 of the member 101 intermediate the edge of the terminal 45B and the portion 103 provides the flexure means 83B for the first switch blade 28B as the member 101 is relatively thin and is thereby relatively flexible whereas the member 100 is relatively thick and thereby is substantially rigid from the flexure portion 83B to the contact 25B as illustrated.

The remaining portion 106 of the member 101 that extends from the portion 103 thereof that is secured to the end 104 of the member 100 by the rivet means 102, as well as by the additional spot welding thereof, defines the second switch blade means 31B of the switch blade unit 24B that carries the contact 26B that cooperates with the other fixed contact 23B of the switch construction 20B as previously set forth, the member 101 defining a flexure area 87B for the switch blade means 31B that is located closely adjacent the secured portion 103 thereof because the remaining portion of the member 101 is suitably stiffened by ribs 107 formed therein and being disposed on opposite sides of the opening 81'B that passes therethrough as illustrated.

In this manner, the switch blade means 28B flexes in the area 83B while carrying the switch blade means 31B therewith with the switch blade means 31B flexing in the area 87B thereof whereby the switch blade unit 24B operates in the same manner as the switch blade unit 24 as previously described.

The restraining means 90B of the switch blade means 28B comprises a threaded fastening member 108 that has a threaded shank 109 that passes loosely through an opening 110 in the member 101 and is threadedly received in a threaded bore 111 formed in the member 100 so as to be secured in an adjustable manner to the switch blade means 28B. An enlarged head 112 of the threaded fastening member 108 will engage against the surface 92B of the switch blade mean 31B in the manner illustrated in FIG. 11 to assure that the contact 26B is held out of contact with the fixed contact 23B when the contact 25B is against the fixed contact 22B as illustrated in FIG. 11. In this manner, the threaded fastening member 108 performs the same function as the restraining means 90 while being adjustable in a manner similar to the adjusting member 96 previously described.

While the members 100 and 101 that form the switch blade unit 24B previously described can be formed of any suitable material, it has been found that the member 100 can be formed from brass which is a good electrical conductor and be relatively thick as illustrated while the member 101 can be formed from beryllium copper and be relatively thin as illustrated so as to have excellent spring properties as well as be a good electrical conductor.

Since the operation of the switch construction 20B utilizing a switch blade unit 24B of this invention is substantially the same as the operation of the switch construction 20 utilizing the switch blade means 24 as previously described, operation of the switch construction 20B will not be further described.

However, when forming the switch constructions 20 and 20B as previously set forth, it may be desired not to utilize the switch blade means 31 and 31B and thereby only provide a switching operation by the movement of the contacts 25 and 25B relative to the fixed contacts 22 and 22B whereby the switch blade units 24 and 24B would only have the switch blade means 28 and 28B.

Figure 13:
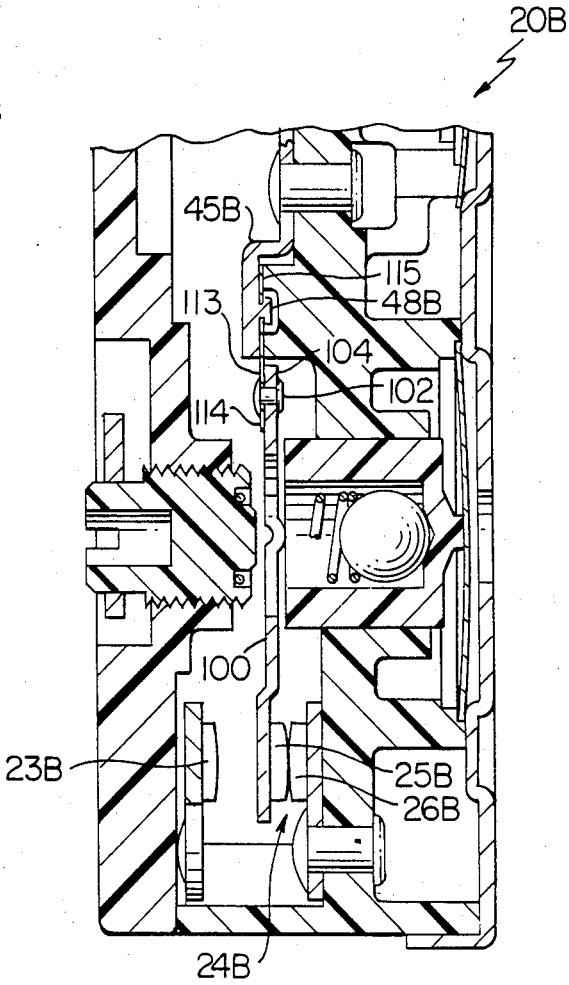
FIG. 13 is a view similar to FIG. 11 and illustrates the switch blade unit formed with only one switch blade means.

For example, it can be seen in FIG. 13 that the switch construction 20B has the switch blade unit 24B only comprising the member 100 and a short flexible member 113 having a first portion 114 secured to the end 104 of the member 100 by the rivet means 102, as well as by additional spot welding as desired, and having the other end 115 thereof secured to the terminal 45B by the rivet means 48B, as well as by additional spot welding as desired, whereby the flexible member 113 forms the same function as the portions 103 and 105 of the member 101 previously described.

In a like manner, the switch blade means 31 can be eliminated from the switch construction 20 so that the switch blade unit 24 thereof will only comprise the switch blade member 28 which, of course, is fastened to the terminal 45 by the rivet means 48 as previously set forth.

Therefore, it can be seen that this invention not only provides a new electrical switch construciton, but also this invention provides a new method of making such a switch construction or the like.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making an electrical switch construction, said method comprising the steps of providing a support means, disposing a pair of spaced apart first and second fixed contacts to be carried by said support means, disposing a moveable switch blade unit to be carried by said support means so that the contact means of the switch blade unit will be disposed in contact with said first fixed contact and out of contact with said second fixed contact when said switch blade unit is in a first portion thereof and for being disposed in contact with said second fixed contact and out of contact with said first fixed contact when said switch blade unit is in a second position thereof, and forming said switch blade unit to have a first flexible switch blade means having opposed ends one of which is secured to said support means and the other of which carries a first part of said contact means for making or breaking contact with said first contact means and a second flexible switch blade means having opposed ends one of which is secured to said first switch blade means to be carried thereby and the other of which is spaced from said other end of said first switch blade means and carried a second part of said contact means for making or breaking contact with the second fixed contact, the improvement comprising the steps of forming said first switch blade means with abutment means for engaging said second switch blade means with an impact force when said switch blade unit is being moved from said second position thereof to said first position thereof and a contact welded condition exists between said second fixed contact and said second part of said contact means, and forming said first switch blade means to have a normal bias tending to move said switch blade unit to said first position thereof.

2. A method of making an electrical switch construction as set forth in claim 1 and including the step of forming said second switch blade means to have a normal bias to tend to maintain said other end thereof spaced from said other end of said first switch blade means a certain distance when said switch blade unit is in said first position thereof.

3. A method of making an electrical switch construction as set forth in claim 1 and including the step of forming said second switch blade means to have a flexure portion thereof that is disposed closely adjacent said one end thereof.

4. A method of making an electrical switch construction as set forth in claim 1 and including the step of forming an actuator means to be carried by said support means and be operatively associated with said switch blade unit for causing movement of said switch blade unit between said first and second position thereof.

5. A method of making an electrical switch construction as set forth in claim 1 and including the step of forming said first switch blade means to have a flexure portion thereof that is disposed closely adjacent said one end thereof.

6. In a method of making an electrical switch construction, said method comprising the steps of providing a support means, disposing a pair of spaced apart first and second fixed contacts to be carried by said support means, disposing a movable switch blade unit to be carried by said support means so that the contact means of the switch blade unit will be disposed in contact with said first fixed contact and out of contact with said second fixed contact when said switch blade unit is in a first position thereof and for being disposed in contact with said second fixed contact and out of contact with said first fixed contact when said switch blade unit is in a second position thereof, forming said switch blade unit to have a first flexible switch blade means having opposed ends one of which is secured to said support means and the other of which carries a first part of said contact means for making or breaking contact with said first contact means and a second flexible switch blade means having opposed ends one of which is secured to said first switch blade means to be carried thereby and the other of which is spaced from said other end of said first switch blade means and carries a second part of said contact means for making or breaking contact with said second fixed contact, forming said first switch blade means to have a normal bias tending to move said switch blade unit to said first position thereof, and forming said second switch blade means to have a normal bias to tend to maintain said other end thereof spaced from said other end of said first switch blade means a certain distance when said switch blade unit is in said first position thereof, the improvement comprising the step of forming said switch blade unit to have restraining means operatively interconnected with said second switch blade means to prevent said other end thereof from being spaced from said other end of said first switch blade means said full certain distance when said switch blade unit is in said first position thereof whereby the spacing between said other ends is less than said certain distance when said switch blade unit is in said first position thereof.

7. A method of making an electrical switch construction as set forth in claim 6 and including the step of forming said restraining means to be adjustable whereby the spacing between said other ends can be adjusted within limits to various spacings that are less than said certain distance when said switch blade unit is in said first position thereof.

8. A method of making an electrical switch construction as set forth in claim 7 and including the step of forming said restraining means to be carried by said first switch blade means.

9. A method of making an electrical switch construction as set forth in claim 8 and including the step of forming said restraining means to comprise an L-shaped tab means carved and bent from said first switch blade means and having a part operatively engaging said second switch blade means on the side of said second switch blade means that is opposite to the side thereof that is disposed adjacent said first switch blade means when said switch blade unit is in said first position thereof.

10. A method of making an electrical switch construction as set forth in claim 9 and including the step of forming said part to be spaced from said side of said second switch blade means when said switch blade unit is in said second position thereof.

11. A method of making an electrical switch construction as set forth in claim 7 and including the step of forming said restraining means to comprise a member having a threaded shank portion threadedly fastened to said first switch blade means and an enlarged headed portion operatively engaging said second switch blade means on the side of said second switch blade means that is opposite to the side thereof that is disposed adjacent said first switch blade means when said switch blade unit is in said first postion thereof.

12. A method of making an electrical switch construction as set forth in claim 11 and including the step of forming said enlarged head of said member to be spaced from said side of said second switch blade means when said switch blade unit is in said second position thereof.

* * * * *